United States Patent [19]

Buttermore et al.

[11] Patent Number: 4,974,273

[45] Date of Patent: Dec. 4, 1990

[54] DART TOOL

[76] Inventors: Edward A. Buttermore, 1680 Stone Ave., Addison, Ill. 60101; Ronald G. Maple, 1217 Nordic, Bensenville, Ill. 60106

[21] Appl. No.: 457,383

[22] Filed: Dec. 27, 1989

[51] Int. Cl.[5] ..... B25F 1/00

[52] U.S. Cl. ..... 7/170; 7/138; 81/488

[58] Field of Search ..... 7/105, 106, 138, 169, 7/170; 81/488; 29/238, 239

[56] References Cited

U.S. PATENT DOCUMENTS

| | | | |
|---|---|---|---|
| 2,498,839 | 2/1950 | Bennett et al. | 254/134.3 R |
| 4,037,275 | 7/1977 | Schor | 7/106 X |
| 4,716,610 | 1/1988 | Therkildsen et al. | 81/488 X |

FOREIGN PATENT DOCUMENTS

| | | | |
|---|---|---|---|
| 968582 | 4/1950 | France | 7/138 |
| 58-82208 | 5/1983 | Japan . | |

*Primary Examiner*—James G. Smith

*Attorney, Agent, or Firm*—Dressler, Goldsmith, Shore, Sutker & Milnamow, Ltd.

[57] ABSTRACT

A compact, pocket-sized dart repair tool having a planar, elongated handle with a pin-like protuberance, a flight lock-opening portion, and a flight lock-closing portion. The flight lock-opening portion has a wedge-like spade. The flight lock-closing portion has a conical socket or other apertures extending through the tool. The tool is useful, via the pin-like protuberance, to tighten or loosen the threaded connection between a shaft of the dart and the barrel of the dart. The tool is useful, via the flight lock-opening portion, to open a flight lock of a dart. The tool is useful, via the flight lock-closing portion, to close the flight lock.

7 Claims, 2 Drawing Sheets

FIG. 1
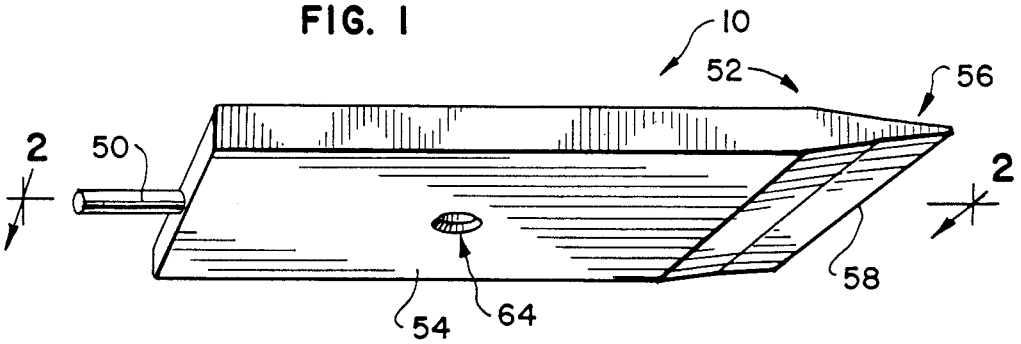
FIG. 2
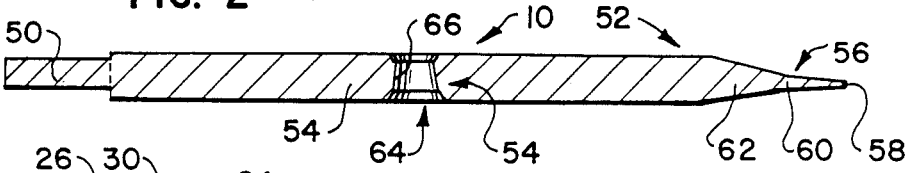
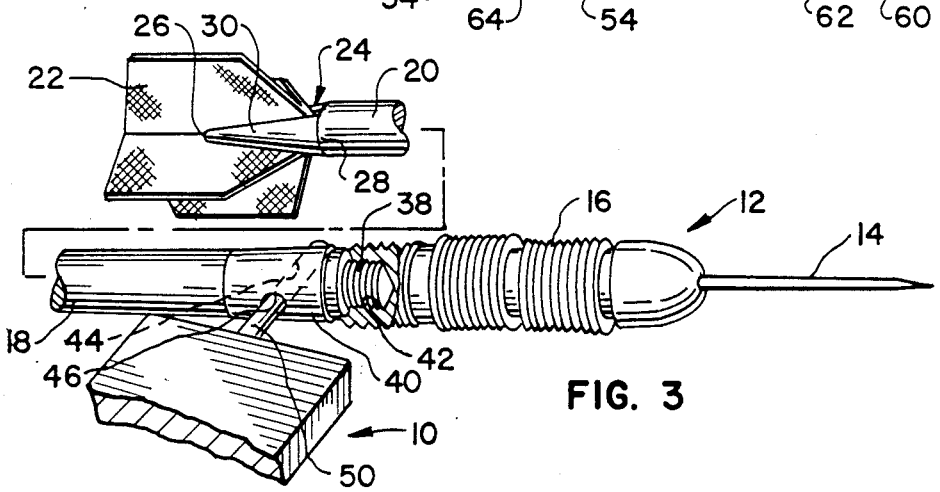
FIG. 3
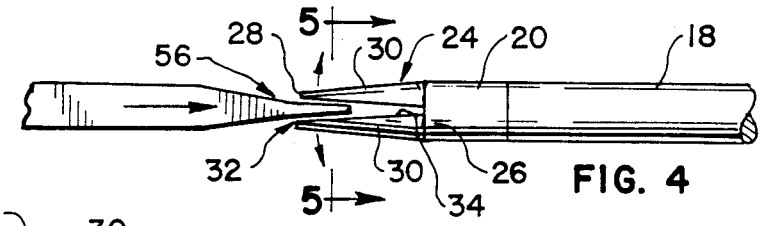
FIG. 4
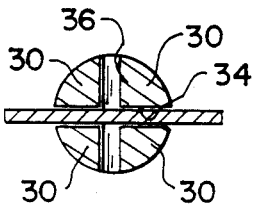
FIG. 5
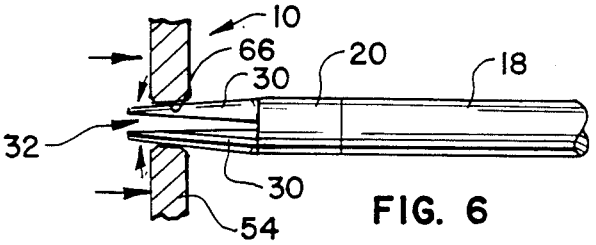
FIG. 6

DART TOOL

BACKGROUND OF THE INVENTION

This invention pertains to a novel tool useful to tighten or loosen a threaded connection between a shaft of a dart and a barrel of the dart, to open a flight lock of the dart, and to close the flight lock.

BACKGROUND OF THE INVENTION

Tournament darts and other games using thrown darts provide countless hours of enjoyment and competition for countless players.

Typically, a dart used in such games has four main parts aligned along a longitudinal axis of the dart. A pointed tip is affixed to a barrel so that the tip extends forwardly from the distal end of the barrel. A shaft extends rearwardly from the barrel and connected thereto at a threaded connection. A flight lock is provided at the proximal or rear end of the shaft. A cross-shaped flight is mounted in the flight lock.

Typically, the flight lock has a conical portion with a smaller end and a larger end and with four bendable prongs defining a cross-shaped slot opening at the smaller end. The cross-shaped flight is pressed into the cross-shaped slot, in which the flight is retained by the prongs. Typically, the flight is made of lightweight, reinforced fabric, foil, or polymeric film. Thus, the flight is a wearable part, which needs to be occasionally replaced.

Commonly, the shaft has a transverse hole, into which a pin is insertable. The pin and the shaft are rotated about the axis of the dart while the barrel is held, or vice versa, to tighten or loosen the threaded connection between the shaft and the barrel. It is a known practice to use the tip of a second dart as the pin. Such a practice is not recommended, however, since it creates a risk of bending the tip of the second dart.

Commonly, a knife blade or similar tool is used to open the flight lock. Such tool is used to spread the bendable prongs sufficiently for the cross-shaped flight to be easily pressed into the cross-shaped slot yet retained securely therein by the bendable prongs.

If the flight lock has been opened too far, the cross-shaped flight is not retained securely in the cross-shaped slot. It then is necessary to press the bendable prongs so as to close the flight lock. However, it is difficult to do so without twisting the bendable prongs, particularly if a pair of pliers or similar tool is used.

For a considerable time period there has existed a need, to which this invention is addressed, for a compact, pocket-sized tool having multiple working elements for repairing or adjusting a dart of the type noted above, all provided with the same unitary handle or grip means.

SUMMARY OF THE INVENTION

This invention provides a novel combination tool useful in repairing or adjusting a dart having assembled barrel and shaft body portions and provided with a flight at the proximal end thereof.

Basically, the tool provided by this invention has at least a flight lock-opening portion and a flight lock closing-portion, as described below.

The flight lock opening portion has a wedge-shaped spade adapted to be axially welded into a cross-shaped slot for opening the flight lock. In a first opening step, the spade spreads the two prongs on each side of the spade away from the first plane comprising the axis of the dart. In a second opening step, the spade spreads the other two prongs, i.e., those on each side of the spade away from a second plane comprising the longitudinal axis of the dart, i.e., the axis along the shaft portion of the dart, and crossing the first plane perpendicularly at such axis.

The flight planar lock-closing portion has a socket defined in a planar handle portion that terminates at one end in the wedge-shaped spade. Preferably, the socket extends through the tool and has a relatively larger aperture at one end and a relatively smaller aperture at the opposing end. The preferred socket configuration conforms generally to the conical portion of the flight lock and is adapted to receive such portion when such portion is inserted axially into the socket. A frusto-conical wall that defines the socket is adapted to press the bendable prongs toward the axis when the conical portion of the flight lock is pressed axially into the socket.

The tool provided by this invention also can be provided with a pin-like protuberance that is insertable into a transverse hole in the shaft of the dart for adjusting assembled dart body portions, such as the barrel and the shaft of the dart. Relative rotation of the barrel and the shaft about the longitudinal axis of the dart, so as to tighten or loosen the threaded connection between the barrel and the shaft, is facilitated by the tool when the pin-like protuberance is inserted into such hole.

The tool provided by this invention can be compactly made, preferably from a flat bar of tool steel, as a pocket-sized tool.

These and other objects, features, and advantages of this invention are evident from the following description of a preferred embodiment of this invention with reference to the accompanying drawing.

BRIEF DESCRIPTION OF THE DRAWING

FIG. 1 is a larger-than-actual, perspective view of a dart repair tool constituting a preferred embodiment of this invention.

FIG. 2 is a sectional view taken along plane 2—2 of FIG. 1.

FIG. 3 is a partly fragmentary, perspective view of a dart with a shaft, with which a pin-like protuberance of the same tool is coacting.

FIG. 4 is a fragmentary, elevational view showing parts of the same dart, namely a portion of the shaft and a flight lock, with which a flight lock-opening portion of the same tool is coacting.

FIG. 5 is a sectional view taken along plane 5—5 of FIG. 4.

FIG. 6 is a fragmentary, elevational view showing a portion of the shaft and a flight lock, with which a flight lock-closing portion of the same tool is coacting.

DETAILED DESCRIPTION OF THE PREFERRED EMBODIMENT

Figure 7:
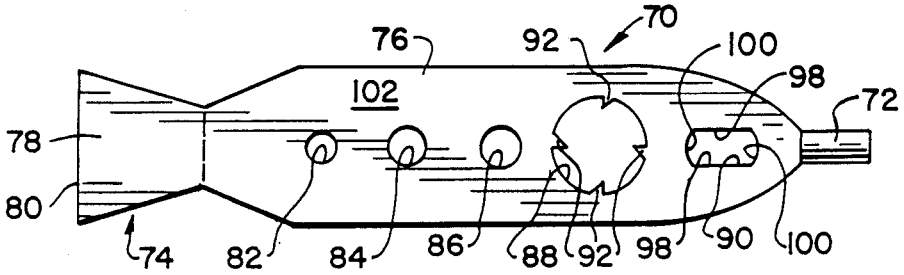
FIG. 7 is a plan view of another dart repair tool embodying the present invention.

Referring to the drawings, a compact, pocket-sized tool 10 that constitutes a preferred embodiment of this invention is shown in FIGS. 1 and 2. The tool 10 has multiple uses in repairing or adjusting a dart 12 illustrated in FIG. 3.

As shown in FIG. 3, the dart 12 is assembled from four main parts, which define the longitudinal axis of the dart 12. A pointed tip 14 is affixed to barrel 16, so that the tip 14 extends forwardly from the distal or front end of the barrel 16. The barrel 16 and a shaft 18 constitute dart body portions that are assembled to each other, at a threaded connection, so that the shaft 18 extends backwardly from the barrel 16. A flight lock 20 is attached to the shaft 18 at the proximal end of the dart 12.

The flight lock 20 is used to mount a cross-shaped flight 22. The flight 22 is made of light-weight, reinforced fabric, foil or polymeric film. The flight 22 is a wearable part, which needs to be occasionally replaced.

The flight lock 20 has a conical portion 24 with a smaller end 26 and a larger end 28. The conical portion 24 has four bendable prongs 30, which define a cross-shaped slot 32. The slot 32 opens at the smaller end 26 and extends axially into the flight lock 20. The cross-shaped slot 32 has a first portion 34 and a second portion 36, which crosses the first portion 34 perpendicularly at the axis of the dart 12.

The flight lock 20 is opened by spreading the bendable prongs 30 away from two orthogonal planes, which cross at the axis of the dart 12, so as to widen the first and second portions of the slot 32 where the slot opens. The flight lock 20 is closed by bending the prongs 30 oppositely.

When the flight lock 20 has been opened sufficiently, the cross-shaped flight 22 can be axially inserted into the cross-shaped slot 32. Unless the flight lock 20 has been opened too far, the cross-shaped flight 22 is retained securely in the cross-shaped slot 32 by the bendable prongs 30, which frictionally engage the flight 22. However, if the flight lock 20 has been opened too far, the flight 22 is not retained securely in the slot 32.

A threaded stud 38 is attached, via a ferrule 40, to the front end of the shaft 18 so as to extend forwardly from the shaft 18. The back end of the barrel 16 is formed with an axial, threaded socket 42, which opens backwardly. The socket 42 is adapted to receive the threaded stud 38, so as to define the threaded connection between the barrel 16 and the shaft 18. The shaft 18 has a transverse hole 44, which is located near the front end of the shaft 18. The hole 44 opens, at each end, into a hole 46 of a similar size in the ferrule 40.

As shown in FIGS. 1 and 2, the tool 10 has a pin-like protuberance 50, a flight lock-opening portion 52, and an elongated planar handle 54 that defines therewith a flight lock-closing portion such as a socket or aperture 64. The tool 10 is useful, via the pin-like protuberance 50, to tighten or loosen the threaded connection between the barrel 16 and the shaft 18. The tool 10 is useful via the flight lock-opening portion 52, to open the flight lock 20. The tool 10 is useful, via the flight lock-closing portion in the handle 54, to close the flight lock 20.

The tool 10 is machined from a flat bar of tool steel. The pin-like portion 50 and the flight lock-opening portion 52 are unitary with the handle 54 and are machined respectively on opposite ends of the flat bar. Preferably, the flat bar has a width of approximately 9/16 inch and a thickness of approximately $\frac{1}{8}$ inch, and the tool 10 has an overall length of approximately 2 $\frac{3}{4}$ inches. If desired, the tool 10 may be alternatively assembled from two or more separate pieces.

The pin-like protuberance 50 preferably is cylindrical. Preferably, such protuberance 50 has a diameter of approximately 0.09 inch and a length of approximately $\frac{3}{8}$ inch. The protuberance 50 is insertable into and through the transverse hole 44 and the shaft 18 (FIG. 3). The protuberance 50 enters and exits such hole 44 via the holes 46 in the ferrule 40.

Relative rotation of the barrel 16 and the shaft 18 about the axis of the dart 12, so as to tighten or loosen the threaded connection between the barrel 16 and the shaft 18, is facilitated by the tool 10 when the pin-like portion 50 is inserted into the hole 44. The tool 10 aids someone holding the barrel 16 to apply torque to the shaft 18.

The flight lock-opening portion 52 has a wedge-shaped spade 56, which has a blunt end 58. The wedge-shaped spade 56 has a leading portion 60 tapering at a relatively smaller included angle and a trailing portion 62 tapering at a relatively larger included angle. Preferably, each such portion of the wedge-shaped spade 56 has a length of approximately 3/16 inch, a thickness of approximately 0.004 inch at the blunt end 58, and a thickness of approximately 0.22 inch where the leading and trailing portions meet.

As shown in FIGS. 4 and 5, the wedge-shaped spade 56 is adapted to be axially wedged into the first portion 34 of the cross-shaped slot 32, in a first step in opening the flight lock 20, so as to spread the bendable prongs 30 on each side of the spade 56 away from a first plane comprising the axis. Similarly, the wedge-shaped spade 56 is adapted to be axially wedged into the second portion 36 of the cross-shaped slot 32, in a second step in opening the flight lock 20, so as to spread the bendable prongs on each side of the spade 56 away from a second plane comprising the axis in crossing the first plane perpendicularly at the axis.

The flight-lock closing portion defined in the handle 54 has a through socket 64 preferably of frusto-conical confirmation. The socket 64 has a relatively larger, open end, which is counter-bored, and a relatively smaller, open end, which is also counter-bored. The socket 64 conforms generally to the conical portion 24 of the flight lock 20 and is adapted to receive such portion 24 when such portion 24 is inserted axially into the socket 64. The socket 64 is defined by a conical wall 66 in the handle 54. As best seen in FIG. 6, the conical wall 66 is adapted to press the bendable prongs 30 toward the axis of the dart 12 when the conical portion 24 of the flight lock 20 is pressed axially into the socket 64, thereby to close the flight lock 20.

As shown and described, the tool 10 is compact, and pocket-sized, and has multiple uses in repairing the dart 12.

Figure 8:
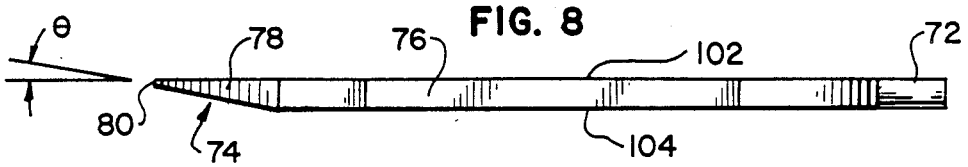
FIG. 8 is an elevational view of the dart repair tool shown in FIG. 7.
Figure 9:
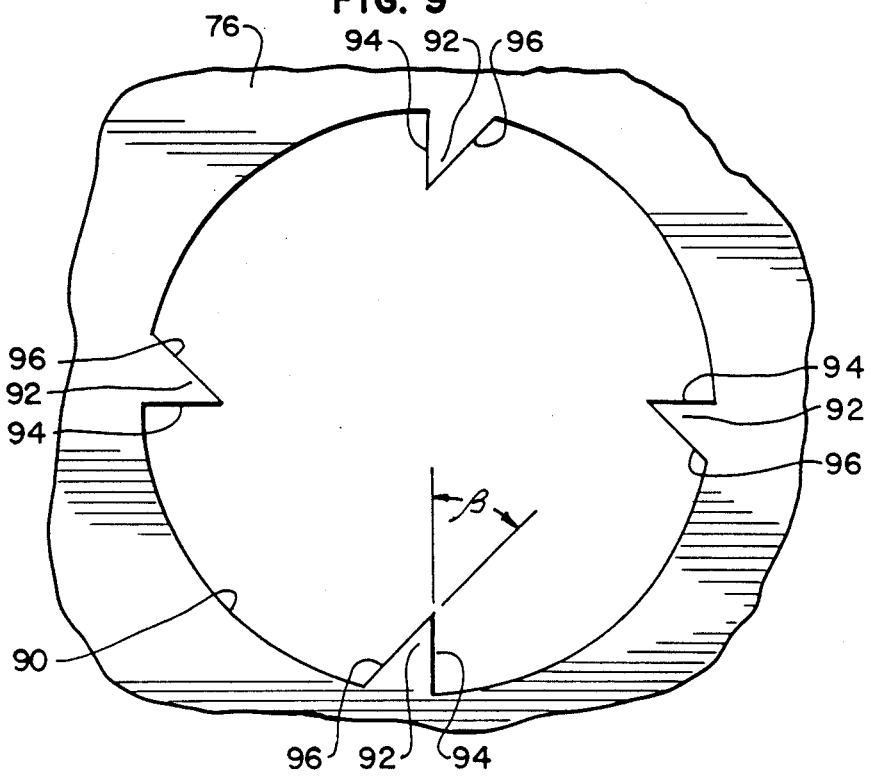
FIG. 9 is a greatly enlarged detail of one adjustment aperture shown in FIG. 7.

Referring again to the drawings, a compact, pocket-sized tool 70 that constitutes an alternative embodiment of this invention is shown in FIGS. 7, 8 and 9. The tool 70 is similar to the tool 10 in that the tool 70 has a pin-like protuberance 72, a flight lock-opening portion 74, and an elongated planar handle 76, and in that the tool 70 is machined from a flat bar of tool steel.

The pin-like protuberance 72 is similar to the pin-like protuberance 50 of the tool 10 and functions similarly. The flight lock-opening portion 74, which has a wedge-shaped spade 78 with a blunt end 80 defining an included angle ($\Theta$) of about 15° to about 18°, preferably about 16°, is similar to the flight lock-opening portion 52 and functions similarly. The elongated planar handle 76 defines plural adjustment apertures 82, 84, 86, 88, and 90 of varying configurations.

The apertures 82, 84, and 86 are cylindrical, and circular in cross-sections, and have different diameters. Each of the apertures 82, 84, and 86 functions generally as the socket 64 of the tool 10 functions.

The aperture 88 is cylindrical, and circular in cross-section, except that four teeth 92 extend from its margin. Each tooth 92 has a flat surface 94 extending radially and a flat surface 96 defining an included angle ($\beta$) of about 45° with the flat surface 94 of such tooth 92. The aperture 88 is adapted to receive a dart barrel (not shown) made of plastic or soft metal, such as brass. The teeth 92 tend to bite into the dart barrel so as to prevent relative rotation between the dart barrel and the tool 70 in one rotational sense, i.e., in a clockwise sense when the tool 70 is viewed as in FIG. 7.

The aperture 90 is elongate in cross-section with two parallel, straight margins 98 and with two confronting, arcuate margins 100. The aperture 90 is adapted to receive a dart barrel (not shown) of a known type having a configuration conforming generally to the aperture 90.

The handle 72 has flat lands 102 and 104, which can be provided with decorative etching, owner's initials, promotional logos, and the like, if desired.

Various modifications may be made in the tools described above without departing from the scope and spirit of this invention.

We claim:

1. A dart tool suitable for repairing or adjusting a dart and comprising an elongated, planar handle means terminating at one end in a wedge-shaped spade for opening a flight lock in a dart, terminating at the other end thereof in a pin-like protuberance having a cylindrical configuration, and defining within the handle means at least one aperture sized to receive and close said flight lock.

2. The dart tool in accordance with claim 1 wherein plural apertures are defined within the handle means.

3. The dart tool in accordance with claim 1 wherein plural apertures are defined within the handle means and wherein peripheral teeth extend into one of said apertures from said handle means.

4. The dart tool in accordance with claim 1 wherein plural apertures are defined within the handle means and wherein one of said apertures has an elongate configuration.

5. A dart tool suitable for repairing or adjusting a dart and comprising an elongated, planar handle means terminating at one end in a wedge-shaped spade for opening a flight lock in a dart and defining within the handle means at least one aperture having a frusto-conical configuration and sized to receive and close said flight lock.

6. The dart tool in accordance with claim 5 wherein said elongated handle means terminates at the other end thereof in a pin-like protuberance for adjusting fit of assembled dart body portions.

7. The dart tool in accordance with claim 6 wherein said wedge-shaped spade and said pin-like protuberance are unitary with the handle means.

* * * * *